US005310005A

United States Patent [19]

Dollison

[11] Patent Number: 5,310,005

[45] Date of Patent: May 10, 1994

[54] FLAPPER VALVE ASSEMBLY WITH FLOATING HINGE

[75] Inventor: William W. Dollison, Dallas, Tex.

[73] Assignee: Halliburton Company, Houston, Tex.

[21] Appl. No.: 900,665

[22] Filed: Jun. 19, 1992

Related U.S. Application Data

[63] Continuation-in-part of Ser. No. 692,193, Apr. 26, 1991, Pat. No. 5,145,005.

[51] Int. Cl.[5] ..... E21B 34/14; E21B 34/12

[52] U.S. Cl. ..... 166/334; 137/527; 166/242; 166/323; 166/332; 175/318; 251/303

[58] Field of Search ..... 166/332, 334, 321, 319; 251/303, 357

[56] References Cited

U.S. PATENT DOCUMENTS

| | | | |
|---|---|---|---|
| 2,447,842 | 8/1948 | Cameron et al. | 137/152 |
| 2,912,216 | 11/1959 | Conrad | 166/334 X |
| 2,974,922 | 3/1961 | Keithahn | 166/334 X |
| 3,151,839 | 10/1964 | Mott | 166/334 X |
| 3,713,485 | 1/1973 | Holbert, Jr. | 166/321 |
| 3,788,595 | 1/1974 | Colonna | 251/303 X |
| 4,531,587 | 7/1985 | Fineberg | 166/332 |
| 4,688,593 | 8/1987 | Pringle et al. | 166/332 X |
| 4,706,933 | 11/1987 | Sukup et al. | 251/54 |
| 4,727,939 | 3/1988 | Airey | 166/332 |
| 4,926,945 | 5/1990 | Pringle et al. | 166/321 |
| 4,977,957 | 12/1990 | Pringle | 166/321 |

*Primary Examiner*—Hoang C. Dang

*Attorney, Agent, or Firm*—Tracy W. Druce; Monty L. Ross

[57] ABSTRACT

A flapper valve assembly for use in a flow conduit in a subterranean well, the assembly having a valve closure member pivotally connected to a floating hinge assembly that slidably engages a sleeve comprising the valve seat. A strut assembly comprising circumferentially spaced struts pivotally connected to the valve closure member away from the floating hinge member and pivotally connected to a spring guide surrounding the flow conduit is also provided, and is biased to force the valve closure member toward the closed position.

8 Claims, 2 Drawing Sheets

FLAPPER VALVE ASSEMBLY WITH FLOATING HINGE

CROSS-REFERENCE TO RELATED APPLICATIONS

This application is a continuation in part of Ser. No. 07/692,193, filed Apr. 26, 1991, issued Sep. 8, 1992 as U.S. Pat. No. 5,145,005, which is incorporated by reference herein.

BACKGROUND OF THE INVENTION

1. Field of the Invention

This invention relates to valve and hinge assemblies suitable for use in oil and gas wells, and more particularly, to a valve assembly having a flapper type closure with a "floating" hinge. One aspect of the invention relates to a valve and hinge assembly for use in a tubing retrievable, surface controlled, subsurface safety valve. Another aspect of the invention relates to a valve and hinge assembly for use in controlling the flow of hydrocarbons and drilling fluids upwardly through a well casing whenever the drill string is tripped during drilling.

2. Description of Related Art

Flapper type closures have previously been disclosed, for example, in U.S. Pat. Nos. 1,710,410; 1,871,536; 2,162,578; 2,202,192; 2,354,310; 2,447,842; 3,672,630; 4,531,587; 4,706,933; 4,926,945; 4,977,957; and 5,044,396.

Flapper type closures With flappers that rotate from an open position to a closed position which is substantially perpendicular to the flow direction are disclosed in U.S. Pat. Nos. 2,162,578; 2,202,192; 2,354,310; 2,447,842; 4,531,587; 4,706,933; 4,926,945; and 4,977,957.

Flapper type closures with flappers that rotate from a fully open position to a fully closed position through an included angle of less than about 90 degrees are disclosed in U.S. Pat. Nos. 1,710,410; 1,871,536; 3,672,630; and 5,044,396.

A flapper type closure with a flapper having a cross-section that is a cylindrical sector and having arcuate seating and sealing surfaces generated by the line of intersection of the cylindrical sector with the wall of a cylindrical flow conduit are disclosed in U.S. Pat. No. 3,672,630.

Flapper type closures with struts that are attached to the flappers at a point spaced apart from the hinge point or hinge line are disclosed in U.S. Pat. Nos. 1,871,536; 2,202,192 and 4,706,933. U.S. Pat. No. 4,706,933 discloses a flapper valve having a control link with one end attached to the flapper and the other end attached to a spring-biased, hydraulically operated piston slidably disposed in a valve control cylinder in the valve body.

With the conventional flapper type closures previously disclosed, however, the flapper is pivotally connected at a hinge point or along a hinge line that is integrally formed as part of, or is otherwise fixed in relation to, the valve seat or body. Flapper type closures constructed in this manner experience high stress concentrations at the hinge point(s), especially when the flapper is slammed closed or is forced open against high opposing downhole fluid pressure.

Sealing difficulties are also encountered in using flapper type closures constructed in the conventional manner, especially those with contoured flappers that seal against seats extending obliquely rather than perpendicularly to the flow direction. Lap seals between the sealing and seating surfaces cannot be used because of interference that occurs in the hinge area. Elastomeric seals between the sealing and seating surfaces are therefore needed both to compensate for surface imperfections and to permit slip between interfering portions of the seating and sealing surfaces during opening and closing of the flapper.

The production of valve seats or bodies with a fixed hinge and the installation of elastomeric seals along the sealing or seating surfaces can necessitate special machining or molding procedures that increase part cost and/or undesirably reduce the load bearing area. Additionally, elastomeric seals between the sealing and seating surfaces can suffer compression failures when subjected to loading such as those encountered in downhole applications.

SUMMARY OF THE INVENTION

According to one embodiment of the present invention, a valve assembly is provided that comprises a valve closure member with a "floating" hinge. As used herein, the term "floating" means that the hinge member is adapted to slide back and forth longitudinally through a restricted range of travel whenever the closure member of the valve is either opening or closing. Use of the floating hinge significantly reduces the stress concentration at the hinge point or hinge line of the valve closure member, and also minimizes interference between the valve closure member and the valve seat in the area near the hinge.

According to another embodiment of the invention, a floating hinge assembly is provided that comprises means for establishing a fluid-tight seal between a pivotally mounted closure member and a fixed seating surface without the need for an elastomeric sealing element therebetween.

According to another embodiment of the invention, a floating hinge assembly is provided that comprises a first hinge portion that is longitudinally slidable through a limited range of travel, and a second hinge portion that is pivotally connected to the first hinge portion.

According to another embodiment of the invention, a flapper valve assembly is provided that comprises a generally cylindrical body with a longitudinal bore; a tubular sleeve disposed inside the bore having one end defining a valve seating surface; a flapper with a sealing surface adapted to engage the seating surface, the flapper being pivotally connected to a hinge member that is longitudinally slidable through a limited range of travel inside an annulus between the body and sleeve; and means for biasing the sealing surface into engagement with the valve seating surface.

According to another embodiment of the invention, a flapper valve assembly is provided that comprises a generally cylindrical housing with a longitudinal bore; a valve sleeve disposed inside the housing with an annular space between the housing and the valve sleeve; a seating surface at the bottom of the valve sleeve; a flapper; floating hinge means permitting the flapper to pivot between an open position where the flapper does not block fluid flow through the valve sleeve and a closed position where the sealing surface on the flapper engages the seating surface and blocks such fluid flow; and means for biasing the flapper in the closed position. According to one preferred embodiment of the invention, the floating hinge means comprises a hinge member pivotally connected to the flapper and longitudinally slidable through a restricted range of travel within the annular space between the housing and the valve sleeve.

According to another embodiment of the invention, a flapper valve assembly is provided that comprises a longitudinally extending bore communicating with a tubular conduit, a valve seat disposed within the bore, a pivotally mounted closure member adapted to engage the valve seat and block fluid flow upwardly through the bore, and means for biasing the closure member toward the closed position. The means for biasing the closure member toward the closed position preferably comprises a pair of circumferentially spaced strut assemblies, each strut assembly having one end pivotally connected to the valve closure member and one end pivotally connected to a spring guide surrounding the tubular conduit. The end connected to the closure member is preferably disposed radially inward of the end connected to the spring guide even when the closure member is in the fully open position, and the struts and spring guide are preferably biased to cause the closure member to pivot toward the closed position.

BRIEF DESCRIPTION OF THE DRAWINGS

The apparatus of the invention is further described and explained in relation to the following figures of the drawings wherein.

Like reference numerals are used to indicate like parts in all figures of the drawings.

DESCRIPTION OF THE PREFERRED EMBODIMENTS

The valve and hinge assembly of the invention is particularly useful in oil and gas wells. A preferred use for the invention, as described in greater detail below, is in tubing-retrievable, surface controlled, subsurface safety valves. Alternatively, the valve and hinge assembly disclosed herein can also be used as a casing shut-in valve in place of the flapper valve assembly described in detail in U.S. Pat. No. 5,145,005, incorporated by reference herein, which discloses a structurally similar flapper in combination with a different hinge and preferred biasing means.

Depending upon the particular use involved, the valve and hinge assembly disclosed herein can be selectively locked opened or released by either hydraulic or mechanical means.

Figure 1:
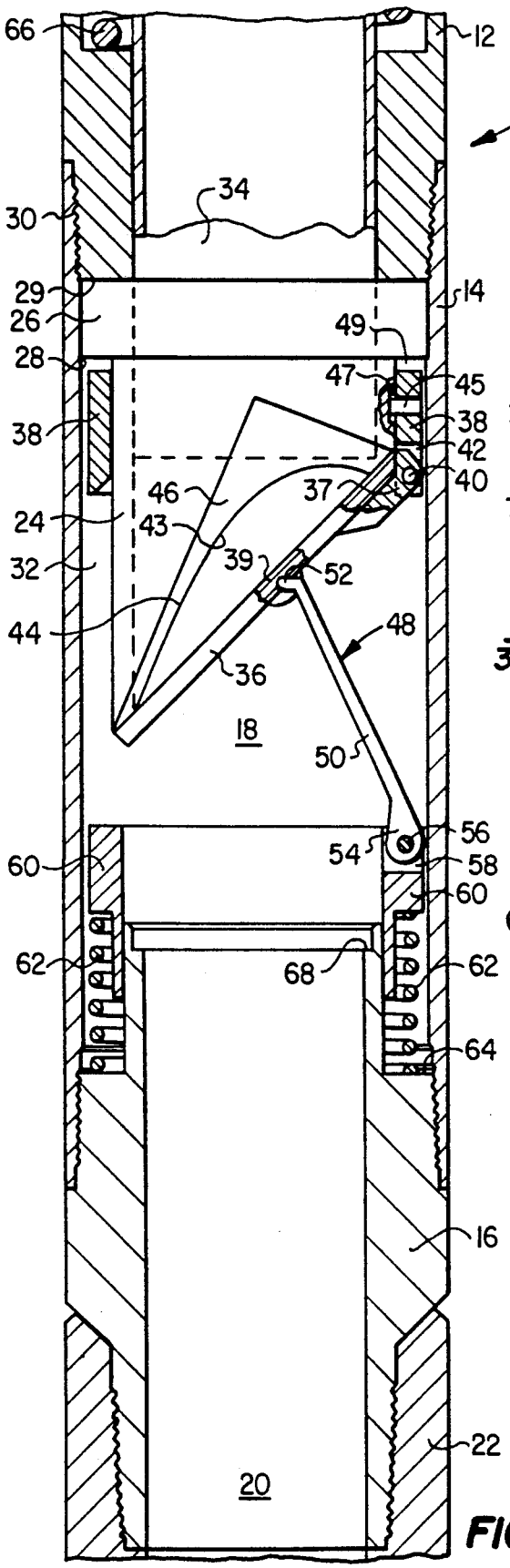
FIG. 1 is an elevation view, partially broken away and partially in section, of a preferred embodiment of the valve and hinge assembly of the invention installed in a tubing-retrievable subsurface safety valve, depicting a flapper valve assembly having a floating hinge with the flapper shown in the closed position.

Referring to FIG. 1, valve assembly 10 preferably comprises threadedly connected tubular body sections 12, 14, 16 defining longitudinal bore section 18 installed in well tubing 22. Valve seat sleeve member 24 is coaxially aligned inside body section 14, where it is supported by flange 26 abutting against annular shoulder 28 and is held in place by lower end 29 and threads 30 of body section 12. Annular space 32 is preferably provided between valve seat sleeve member 24 and body section 14 to accommodate longitudinally slidable ring member 38. Flapper closure member 36 further comprises integral hinge member 37 drilled to receive hinge pin 40, which is inserted through flapper 36 into drilled and slotted section 42 of ring member 38, thereby pivotally connecting flapper 36 to ring member 38.

Figure 2:
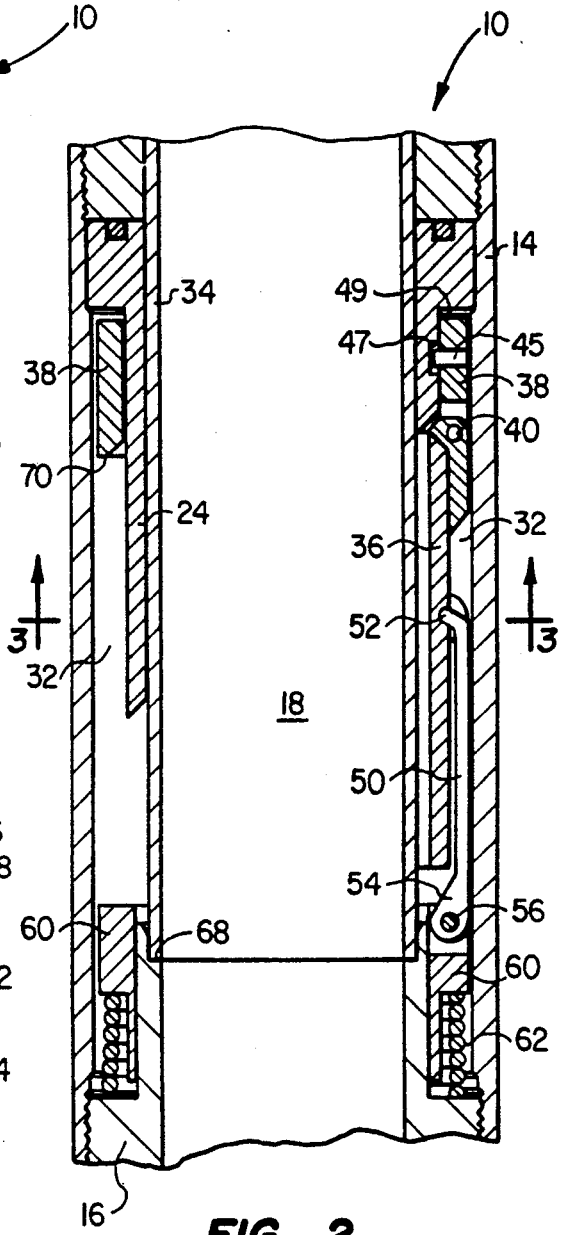
FIG. 2 is a cross-sectional elevation view of the flapper valve assembly of FIG. 1 with the flapper shown in the fully open position.

Referring to FIGS. 1 and 2, ring member 38 is preferably drilled to receive pin 45, which is aligned with slot 47 in the outside wall of valve seat sleeve member 24. Pin 45 and slot 47 cooperate to provide a limited vertical range of travel for ring member 38 inside annulus 32 between valve seat sleeve member 24 and body section 14. The upward range of travel of ring member 38 is also limited by headspace 49 between flange 26. Although only one pin 45 and slot 47 are shown in FIGS. 1 and 2, it is understood that a plurality of circumferentially spaced pins and slots can be used if desired. Also, while ring member 38 is shown as a complete annular ring in FIGS. 1 and 2, it will be appreciated that a semicircular ring section or other functionally equivalent structure can likewise be used within the scope of the invention to provide vertical translational movement of hinge pin 40 relative to valve seat sleeve member 24 and body section 14, thereby creating a floating hinge for flapper closure member 36.

The lower end of valve seat sleeve member 24 preferably comprises a machined section 46 terminating in seating surface 43 formed at some angle, preferably 45 degrees, with the longitudinal axis of sleeve member 24. The preferred flapper 36 for use in valve assembly 10 of the invention is a section of a cylinder having a constant radius of curvature that is substantially the same as the radius of valve seat sleeve member 24. Both the seating surface 43 on valve seat sleeve member 24 and sealing surface 44 on flapper 36 have contours defined by the locus of the intersection of a cylinder having the radius and orientation of flapper 36 with a cylinder having the radius and orientation of valve seat sleeve member 24. Although the floating hinge assembly of the invention as described below can be used with flappers having configurations other than that of flapper 36, such other configurations may require a body section 14 having a larger diameter to avoid interference between the inside wall of the valve body and the flapper as it pivots between its open and closed positions. A significant advantage of valve assembly 10 disclosed herein is the small valve body diameter required to accommodate a given flow line diameter. Because flapper 36 is a cylindrical section, it can be hidden behind flow sleeve 34 when in the open position as shown in FIG. 2, but can be rotated to the fully closed position shown in FIG. 1 without interfering with the inside wall of body section 14.

Figure 3:
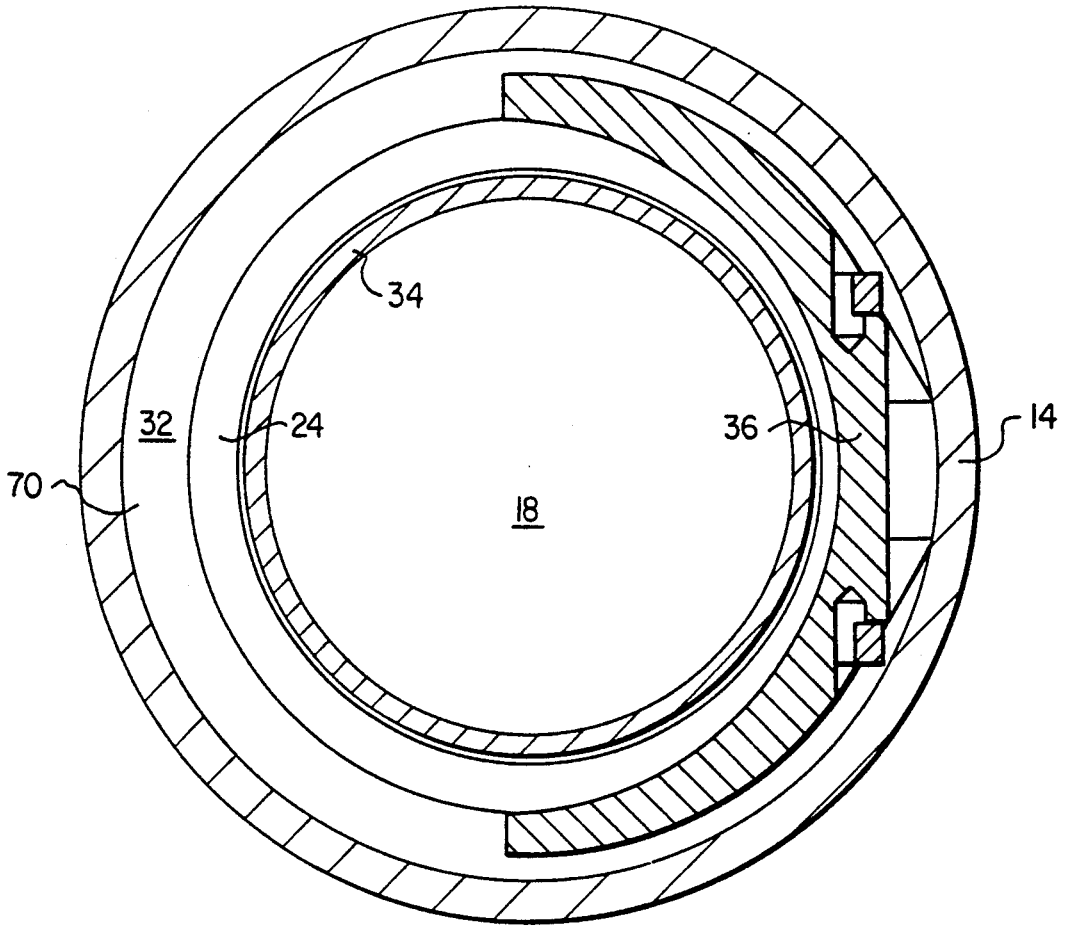
FIG. 3 is a cross-sectional bottom plan view taken along line 3—3 of FIG. 2.
Figure 4:
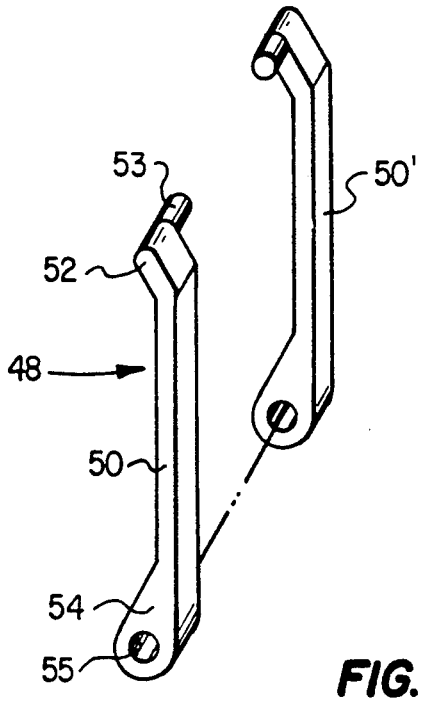
FIG. 4 is a detail perspective view of the strut members shown in FIGS. 1 and 2.

Flapper 36 is preferably also pivotally connected to spring guide 60 by strut assembly 48. Although only one strut 50 is visible in FIGS. 1 and 2, it is seen in FIGS. 3 and 4 that strut assembly 48 preferably comprises a pair of spaced apart struts 50, 50', each of which is pivotally connected to flapper 36 and to spring guide 60. Each strut 50 preferably comprises flapper end 52 having pin member 53 adapted for insertion into a hole drilled in socket 39 of flapper 36. Flapper end 52 of strut 50 is preferably canted radially inward relative to hole 55 in its spring guide end 54 to provide a moment arm for the force exerted by spring 62 under spring guide 60 to assure an initial closing bias on flapper 36. Pin 56 is inserted through hole 55 in piston end 54 of strut 50 into an aligned hole drilled into slot 58 of spring guide 60. Strut assembly 48 is preferably adapted to retract into the annular space 32 between flapper 36 and body section 14 whenever flapper 36 is rotated to the fully open position as shown in FIG. 2.

The use and operation of valve assembly 10 is further described and explained in relation to FIGS. 1–4. As shown in FIG. 1, flapper 36 is normally closed, with sealing surface 44 being held against seating surface 43 by the spring force of spring 62 applied through strut assembly 48 and by any upwardly directed hydraulic force that may be applied to flapper 36 through tubing 22. When flapper 36 is closed, flow sleeve 34 is maintained in the position shown in FIG. 1 by spring 66, which acts on a piston (not shown) connected to the top of flow sleeve 34.

If it is desired to open valve assembly 10, flow sleeve 34 is shifted downward against the force of spring 66 by hydraulic pressure exerted from the surface through a control line (not shown) to the point where its lower end first contacts flapper 36. As flapper 36 begins to rotate downwardly around hinge pin 40, the downwardly directed component of the mechanical load exerted on flapper 36, hinge member 37 and hinge pin 40 by flow sleeve 34 is reduced as ring member 38 slides downwardly relative to valve seat sleeve member 24 until pin 45 reaches the bottom of slot 47. Simultaneously, the downward movement of ring member 38 relative to valve seat sleeve member 24 provides additional clearance between the portions of the seating area 43 and sealing area 44 adjacent to the hinge as flapper closure member 36 rotates downwardly into the fully open position shown in FIG. 2.

Referring to FIG. 2, flow sleeve 34 continues downward until its lower end abuts against annular shoulder 68 of body section 16. As flapper 36 is rotated downwardly by the downward travel of flow sleeve 34, strut 50 pivots upwardly around hinge pin 56, and spring guide 60 is forced downward, compressing spring 62 between the underside of spring guide 60 and upwardly facing annular shoulder 64 of body section 16. When flow sleeve 34 is seated against annular shoulder 68, an uninterrupted cylindrical bore 18 is provided through valve assembly 10.

When the hydraulic pressure is subsequently removed from the piston above flow sleeve 34, spring 66 again causes flow sleeve 34 to move upwardly from the position shown in FIG. 2 to the position shown in FIG. 1. As the lower end of flow sleeve 34 slides upwardly past flapper 36, the force exerted upwardly through spring guide 60 and strut 50 by spring 62 again causes flapper 36 to pivot radially inward toward the closed position.

In addition to reducing the mechanical loading on the hinge pin 40 during the opening or closing of flapper 36 of valve assembly 10, the floating hinge of the invention also allows lapping the seating area 43 and sealing area 44 together without the interference previously experienced using a fixed hinge. Use of the invention disclosed herein permits the formation of a fluid-tight seal between the flapper 36 and valve seat sleeve member 24 without the need for an elastomeric sealing material that is more susceptible to wear, degradation and compression failure.

As mentioned above, valve assembly 10 disclosed herein is similarly useful as a casing shut-in valve in the applications described in U.S. Pat. No. 5,145,005, and it will be appreciated that in such applications, the flow tube of the valve can be designed to be shifted mechanically instead of hydraulically to open or close the valve.

Also, while the apparatus of the invention is described herein in relation to a preferred embodiment in which flapper 36 moves from its fully open to fully closed positions through an included angle of about 45 degrees, it will be appreciated that the structure disclosed herein is similarly useful in flapper valve configurations where the seating surface is disposed at other angles ranging from less than 45 degrees up to 90 degrees.

Other alterations and modifications of the invention will likewise become apparent to those of ordinary skill in the art upon reading the present disclosure, and it is intended that the scope of the invention disclosed herein be limited only by the broadest interpretation of the appended claims to which the inventor is legally entitled.

What is claimed is:

1. A valve assembly comprising:

a generally cylindrical body with a longitudinal bore;

a valve seat sleeve member coaxially aligned within said longitudinal bore, said valve seat sleeve member having one end defining a valve seating area;

an annulus between said body and said valve seat sleeve member;

a hinge member disposed in said annulus, said hinge member comprising means for providing limited sliding engagement between said hinge member and said valve seat sleeve member in a longitudinal direction;

a valve closure member pivotally connected to said hinge member, said valve closure member further comprising a sealing area having a configuration adapted to provide sealing engagement with said valve seating area;

means for biasing said sealing area of said valve closure member into sealing engagement with said valve seating area of said valve seat sleeve member; and said means for biasing the sealing area of the valve closure member into sealing engagement with the valve seating area of the valve seat sleeve member comprises:

a spring guide member supported by the body, the spring guide member surrounding the longitudinal bore below the valve closure member;

a strut assembly having a first end pivotally connected to the valve closure member and a second end pivotally connected to the spring guide member; and a spring member disposed between the spring guide member and the body to bias the spring guide member and strut assembly in the direction of the valve closure member.

2. A flapper valve assembly adapted to selectively control the upwardly flow of fluid through a tubular conduit in a well bore, the valve assembly comprising:

a longitudinally extending bore coaxially aligned and communicating with the tubular conduit;

a valve seat sleeve member disposed within said bore, said valve seat sleeve member comprising a valve seat;

a pivotally mounted closure member comprising means for sealably engaging said valve seat and for blocking fluid flow upwardly through said bore;

a longitudinally slidable hinge member pivotally connecting said closure member to said valve seat sleeve member;

means for limiting the longitudinal range of travel of said hinge member relative to said valve seat sleeve member;

means for biasing said closure member toward engagement with said valve seat;

said means for biasing said closure member toward engagement with said valve seat comprises a pair of laterally spaced strut assemblies, each strut assembly having one end pivotally connected to said valve closure member and one end pivotally connected to a spring guide surrounding the tubular conduit; and said spring guide is spring-biased toward the valve seat.

3. A hinge assembly for a valve comprising a valve support member with a valve seat and a valve closure member that pivots into engagement with the valve seat, the hinge assembly comprising:

a hinge member;

means for pivotally connecting said hinge member to said valve closure member;

means for providing sliding engagement between said hinge member and said valve support member;

means for limiting sliding engagement between said hinge member and said valve support member to a predetermined range of travel; and said valve support member comprises an outwardly facing slot, the hinge member comprises a transverse hole aligned with the slot, and the means for providing sliding engagement between the hinge member and the valve support member is a pin extending from the hole into the slot.

4. The hinge assembly of claim 3 wherein the means for limiting the sliding engagement between the hinge member and the valve support member to a predetermined range of travel are the end walls of the slot.

5. A valve assembly comprising:

a generally cylindrical body with a longitudinal bore;

a valve seat sleeve member coaxially aligned within said longitudinal bore, said valve seat sleeve member having one end defining a valve seating area;

an annulus space between said body and said valve seat sleeve member;

a hinge member disposed in said annulus, said hinge member comprising means for providing limited sliding engagement between said hinge member and said valve seat sleeve member in the longitudinal direction, thereby minimizing interference between a valve closure member and the valve seating area near said hinge member;

said valve closure member pivotally connected to said hinge member, said valve closure member further comprising a sealing area having a configuration adapted to provide sealing engagement with said valve seating area;

said valve closure member being a section of a cylinder having a constant radius of curvature substantially the same as the radius of said valve seat sleeve member;

said valve closure member positioned within said annulus space behind said valve seat sleeve member when said valve assembly is in an open position; and said means for providing limited sliding engagement between said hinge member and said valve seat sleeve member comprises a pin projecting from said hinge member into a slot in said valve seat sleeve member for limited longitudinal travel therein.

6. The valve assembly of claim 5, further comprising:

means for biasing said sealing area of said valve closure member into sealing engagement with said valve seating area of said valve seat sleeve member.

7. The valve assembly of claim 6, wherein said means for biasing said sealing area of said valve closure member into sealing engagement with said valve seating area of said valve seat sleeve member comprises at least one strut and means for biasing he strut.

8. The valve assembly of claim 7, further comprising:

an uninterrupted cylindrical bore is provided through the valve assembly when said valve closure member is positioned within said annulus space behind said valve seat sleeve member when said valve assembly is in an open position.

* * * * *